United States Patent [19]

Cassan

[11] Patent Number: 4,992,054

[45] Date of Patent: Feb. 12, 1991

[54] CONNECTOR WITH A RETRACTABLE BASE PLATE TO PROTECT ITS CONTACT OUTLETS

[75] Inventor: Daniel Cassan, Sucy-en Brie, France

[73] Assignee: Societe Francaise Metallo S.A., France

[21] Appl. No.: 329,705

[22] Filed: Mar. 28, 1989

Related U.S. Application Data

[63] Continuation of PCT FR88/00391 filed Jul. 28, 1988.

[30] Foreign Application Priority Data

Jul. 28, 1987 [FR] France ..... 87 10685

[51] Int. Cl.[5] ..... H01R 9/09

[52] U.S. Cl. ..... 439/76; 439/83; 439/150; 439/247; 439/248; 439/329; 439/571

[58] Field of Search ..... 439/76, 80–83, 439/140, 141, 149, 150, 162, 164, 247, 248, 260, 261, 263, 264, 280, 282, 328, 329, 366, 367, 375, 521, 528, 544, 547, 549, 571, 572, 592, 602, 876, 893

[56] References Cited

U.S. PATENT DOCUMENTS

| | | | |
|---|---|---|---|
| 4,014,601 | 3/1977 | Pittman | 439/876 |
| 4,054,346 | 10/1977 | Schultz | 439/366 |
| 4,072,387 | 2/1978 | Socher | 439/329 |
| 4,469,387 | 9/1984 | McHugh | 439/140 |
| 4,645,287 | 2/1987 | Olsson | 439/83 |
| 4,693,528 | 9/1987 | Asick et al. | 439/571 |
| 4,808,127 | 2/1989 | Swanic | 439/140 |
| 4,820,180 | 4/1989 | Mosquera et al. | 439/248 |
| 4,824,379 | 4/1989 | Roberts et al. | 439/329 |
| 4,824,387 | 4/1989 | de Jong et al. | 439/248 |
| 4,907,987 | 3/1990 | Douly et al. | 439/571 |
| 4,909,745 | 3/1990 | Hayashi | 439/76 |
| 4,915,655 | 4/1990 | Tanaka | 439/83 |

*Primary Examiner*—Paula A. Bradley
*Attorney, Agent, or Firm*—Steinberg & Raskin

[57] ABSTRACT

A connector with a retractable base plate to protect its contact outlets, the connector functioning to ensure connections between various parts of television type cathode ray tubes and correspoding printed circuits, comprises a contact holder casing, a sliding base part supporting the contact holder casing, the sliding base part having hollowed out housings, integral therein, contact outlets into which the housings are respectfully inserted, guiding and click and spring work systems for maintaining said contact outlets in said housing, the aforementioned guiding and click and locking systems functioning to lock the base plate onto the casing whereby pressure brought on the casing perpendicular to the printed circuit causes the base plate coming into contact with the printed circuit to undergo translation, effectuating the passage of contact end pieces from the housing through holes in the base plate whereby the contact outlets can be brazed. The guiding, click and spring work systems comprise a flexible strip of insulating material which is an integral part of the contact holder at one casing at one end, is provided with a step over its whole length, the other end being free and ending a bevelled edge preceded by a shoulder set back in relation to the free end. Other embodiments include the base plate comprising two strips and the guiding and click and spring work systems being in common.

4 Claims, 2 Drawing Sheets

CONNECTOR WITH A RETRACTABLE BASE PLATE TO PROTECT ITS CONTACT OUTLETS

This application is a continuation of an International application filed under the Patent Cooperation Treaty bearing application Ser. No. PCT/FR88/00391 filed July 28, 1988 and which lists the United States as a designated country.

BACKGROUND OF THE INVENTION

The invention relates to connectors each having electrical connections between the various parts of a cathode ray tube and a printed circuit and technically consist of a support made of insulating material in which are circularly located the means of contact for the various connections.

Whereas the means of electrical contact with the cathode ray tube's base are protected by being inside the same connector, this is not the case for the contact outlets to be connected to the printed circuit. These outlets must be on the outside if they are to penetrate the precise holes provided for them in the printed circuit.

As is known, these means of contact consist of wire conducting segments, of a fragile nature. It is, therefore, indispensable to greatly protect them when packing the connector, to avoid their getting out of shape during storage or transport and until such time as they are inserted into the printed circuit.

To avoid possible deterioration a specific type of packing is currently in use and this in turn leads to quite considerable increases in price. Even then, it does not necessarily prove efficient in providing the desired protection.

The present invention remedies the various drawbacks mentioned above by means of an original location of the various parts of the connector; they can then be packed without requiring any special precautions to be taken for storage or transport and, at the same time, the best possible positioning on the printed circuit can be obtained either manually or by machine.

SUMMARY OF THE INVENTION

In the invention, the connector is made of two pieces of insulating material, one of which is a contact-holder casing, while the other forms a base plate of the same shape as the box part.

The base plate contains the same number of housings as contact outlets. It acts both as a protective element as a guide for the contact outlets included in the thickness of the base plate.

The base plate and the contact-holder casing form the connector and can be set off by the relative sliding motion of both parts together. Upon insertion into the printed circuit a levelling of the contact outlets is effectuated and then they are projected beyond their respective housings in the base plate to a predetermined length.

This result is obtained due to cooperation between the guiding means and the integral click and spring work in the casing with the printed circuit holes.

BRIEF DESCRIPTION OF THE DRAWINGS

The advantages and characteristics of the invention can be better understood if reference is made to the following description as well as to the attached drawing on which FIGS. 1, 2 and 3 represent a partial cross-sectional diagram of an embodiment of the connector according to the invention in three different positions relative to the printed circuit, while

DESCRIPTION OF THE PREFERRED EMBODIMENTS

Figure 1:
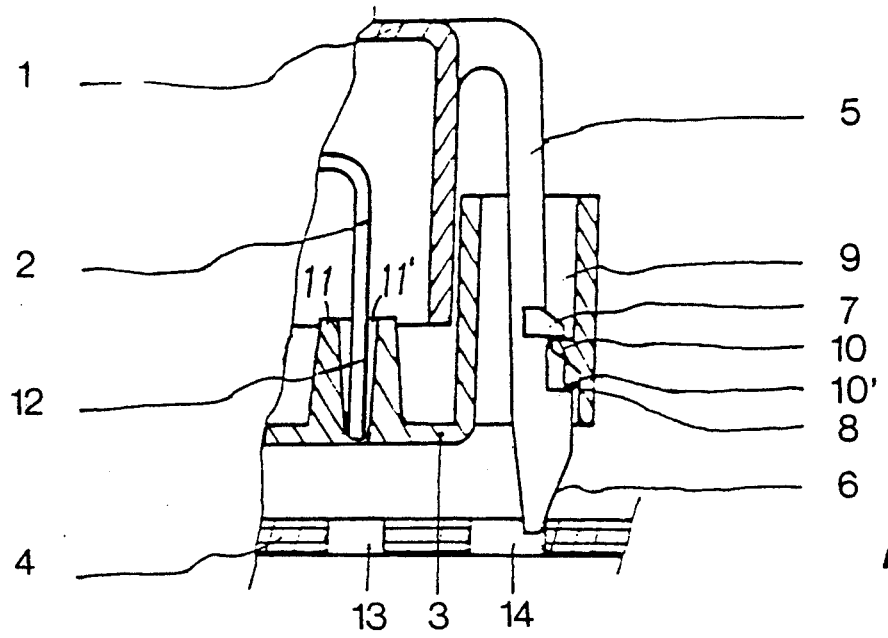
Figure 2:
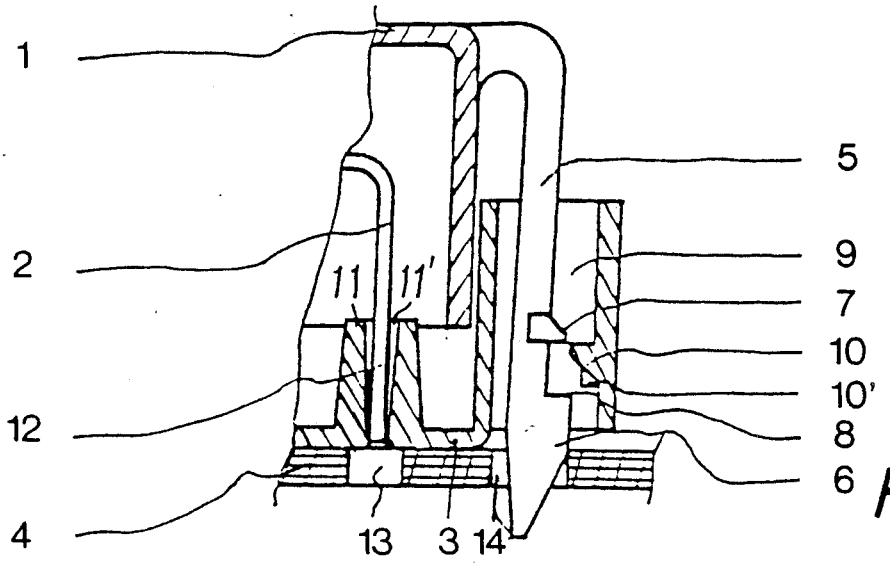
Figure 3:
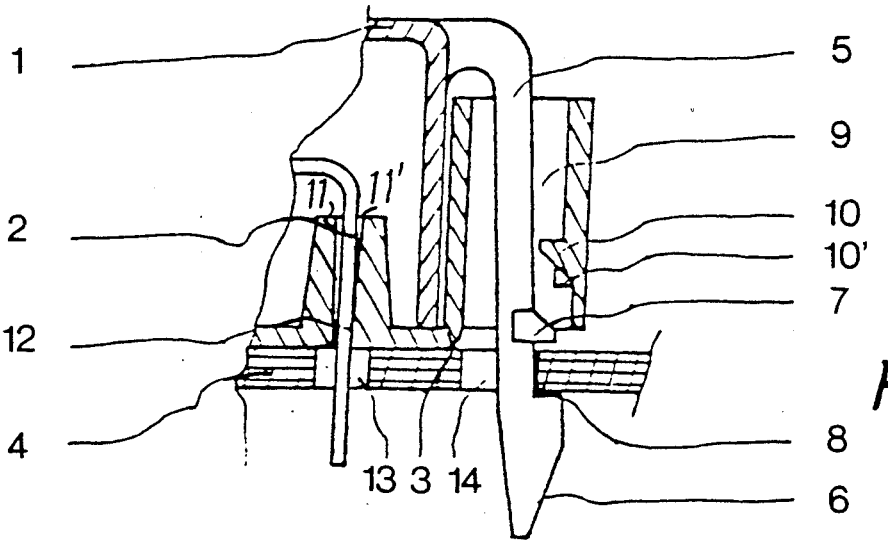

On FIGS. 1, 2 and 3 reference numeral 1 indicates the casing with the appropriate number of electrical contacts. One of these can be seen and bears the reference numeral 2. Naturally, these contacts may be provided with the usual spark gaps of the type normally known to users, since spark gaps are not part of the invention. The base plate part bears refernce 3. The printed circuit to which it corresponds is represented by number 4.

One of the means of guiding and click and spring work corresponding to the connector is shown in three different positions on the three figures. On the one hand, it includes a flexible strip of insulating material 5 such as plastic. It forms an integral part of the casing 1 at one end thereof. The other end, which is left free, forms a bevelled edge 6. The strip 5 has a stop 7 and a shoulder 8 which is set back in respect of bevelled edge 6. It also comprises a housing 9, part of which projects internally at 10, 10', and which is an integral part of base plate 3 into which the strip can slide.

Two, or preferably three, guiding and click spring work systems, like the one just described, may be distributed in the same way at the connector's periphery. The guiding and click and spring work systems may differ in shape from the examples given above.

FIG. 1 gives a partial diagram of the connector 1–3, the way it looks at the final stage of manufacture, ready for storing, transport or handling.

It is presented here in relation to the coresponding printed circuit 4 to which it is to be connected. In this position, the contact outlets 12 are in their respective protective housings, such as 11 on base plate 3. The latter is clicked and sprung by means of stop 10' along with shoulder 8 of strip 5, whereas the base plate is locked by means of projection 10 of housing 9, an integral of base plate 3.

On FIG. 2, pressure exerted on the casing vertically, in reaction to printed circuit 4, provokes lateral displacement of strip 5 by means of bevelled edge 6 on the rim hole 14 in printed circuit 4. This movement in turn provokes lateral displacement of stop 7 of strip 5, which comes away from projection 10 completely, inside housing 9 which is an integral part of base plate 3. Under those conditions, base plate 3 is completely freed mechanically and can undergo translation perpendicular to printed circuit 4, in the direction of casing 1.

FIG. 3 presents the final stage of positioning and fixing of the connector onto printed circuit 4, with total pressure being brought to bear on the casing perpendicular to printed circuit 4, which simultaneously fixes the strip's click and spring work on printed circuit 4, On the other hand, base plate 3 coming into contact with printed circuit 4 undergoes translation, perpendicular to said printed circuit, in the direction of casing 1 and effectuates the passage of contact outlets 12 through holes 11' of base plate 3. Then, holes 13 of the printed circuit cause the contact outlets 12 to extend further onto the printed surface on the welded side, to undergo brazing, which will attach them to printed circuit 4 in the conventional manner.

The above description shows that the protective conditions required for contact outlets 12 are fulfilled perfectly right up until the last moment and that this is done in a simple and efficient manner.

Figure 4:
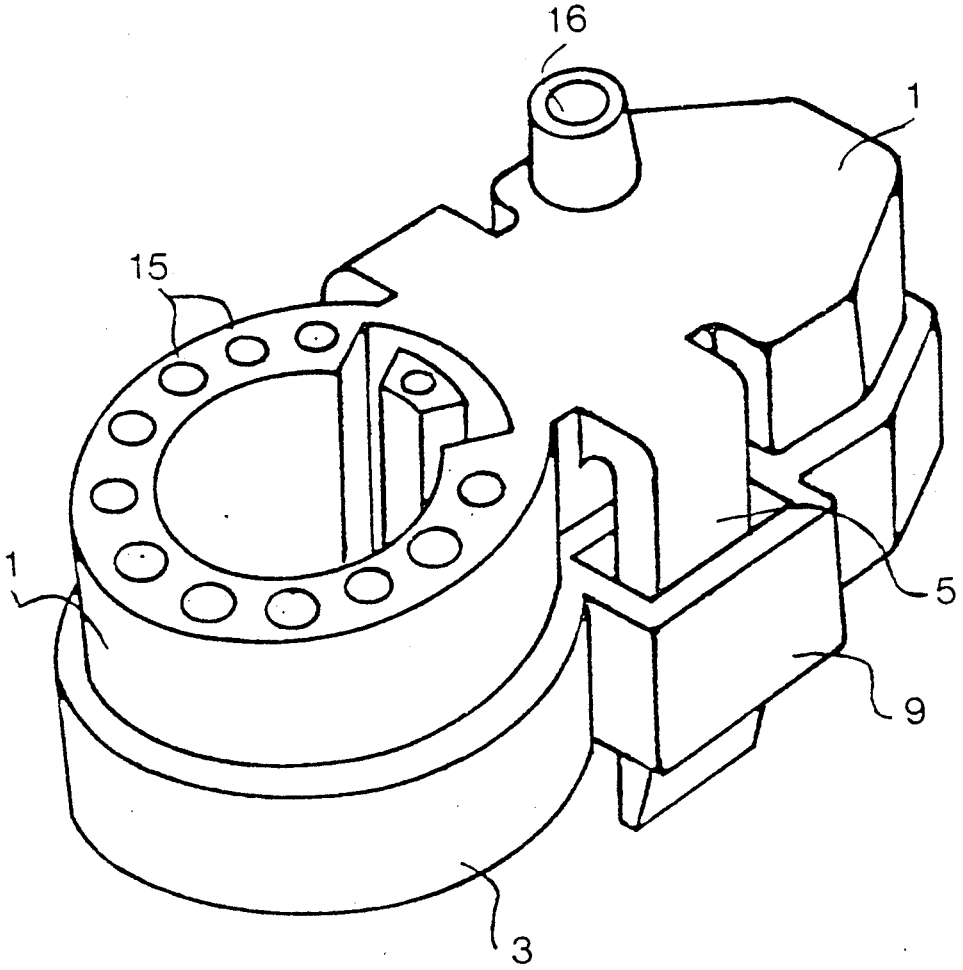
FIG. 4 represents an overhead perspective view of a complete cathode ray tube connector ensuring average connections and very high tension ones between the cathode ray tube and the corresponding printed circuit.

FIG. 4 is a perspective drawing of a complete connector, conforming to the invention. This connector ensures both medium voltage and very high voltage connections of the printed circuit. The references on this figure are identical to those of FIGS. 1, 2 and 3. Casing 1, as well as base plate 3 and also one of the flexible strips 5 and one of the housings 9, which are integral parts of base plate 3, can all be seen.

Reference numeral 15 designates the holes in the casing to allow for passage of cathode ray tube pins, whereas aperture 16 represents the passage provided for the very high voltage connecting cable.

Naturally, modifying the number of parts used or their shape and location would not detract from the framework of the present invention, namely with regard to the guiding assembly or the click and spring locking.

The present invention applies specially to connectors which are destined to ensure connections between parts of a cathode ray tube and a printed circuit, as described. Nevertheless, it may also apply to other connectors requiring efficient protection for their contact outlets.

In summary, the invention comprises a connector for electrically connecting a component, such as a cathode ray tube, to a printed circuit. The connector comprises a base plate 3 having at least one contact protecting housing 11 through which an opening 11' is formed, and a casing 1 which holds at least one electrical contact 2 having an outlet or terminal part 12. The casing 1 is slidably supported on the base plate 3 for movement between a first storage and transport position (FIG. 1) in which the outlet part 12 of the contact 2 is situated within a respective contact protecting housing 11 for protection during storage and transport, and a second operating position (FIG. 3) wherein the outlet part 12 of the contact 2 extends outwardly of its respective contact protecting housing for connection to as printed circuit. The base plate 3 and contact holder casing 1 are held in a first storage and transport position (FIG. 1) with the contact outlet part 12 situated within a contact housing 11 and move relative to each other guidably locking contact outlet part 12 within printed circuit 4 in its operating position (FIG. 3).

The aforementioned holding position of FIG. 1 and the backing position of FIG. 3 are achieved by means including flexible strips 5 integrally hinged at one end to the contact casing 1 and having a free end with a bevelled edge. A notch having a shoulder 8 is formed in each of the strips 5. A stop 7 projects outwardly from the strip 5 rearwardly of the notch. Each strip 5 is received in a corresponding guide housing 9 integral with base plate 3. A projection 10 extends inwardly from the wall of each housing 9. With the contact holder in its transport position shown in FIG. 1, the projection 10 extends into the notch of strip 5 which is biased outwardly to hold the contact holder in the transport condition. When it is desired to fasten the connector to a printed circuit, the strips 5 are aligned over respective holes 14 in the printed circuit board (with contact outlet parts 12 becoming aligned with holes 13 in printed circuit 4) and the connector is moved towards the printed circuit whereupon the strips 5 are cammed inwardly through engagement of the bevelled edges 6 with the rims of holes 14 to disengage the projections 10 from the strip notches. Movement of the connector towards the printed circuit continues until the notch in the outwardly biased strip 5 aligns with the bottom of the printed circuit board whereupon the strips 5 snap or click outwardly as seen in FIG. 3. The connector is locked to the printed circuit board due to the engagement of shoulders 8 of strips 5 by the bottom surface of the printed circuit board.

Finally, it should be noted that the invention, advocated above, to ensure the protection of contact outlets during storage, transport and handling may also be envisaged for distribution and safe handling of any connectors which have been given the right shape for selection and direct insertion from the connector onto the printed circuit by means of handling equipment integrated into automated mounting assembly lines for components.

I claim:

1. A connector for electrically connecting a component, such as a cathode ray tube of the television type, to a printed circuit, comprising:

a base plate having at least one contact protecting and guide housing through which a contact protecting and guide opening is formed;

a contact holder casing holding at least one contact having a terminal part, said contact holder casing being slidably supported on said base plate for movement between a first storage and transport position in which said terminal part of a respective contact is situated within a respective one of said contact protecting and guide openings for protection during storage and transport, and a second operating position in which said terminal part of a respective contact extends outwardly of a respective contact protecting and guide opening for connection to a printed circuit; and holding and locking means provided on said base plate and contact holder casing for releasably holding said contact holder casing in said first storage and transport position with said contact terminal part situated within a respective contact protecting and guide opening and for locking said connector to a printed circuit in said second operating position with said contact terminal part extending outwardly of said contact protecting and guide opening for connection into the circuit.

2. Connector as defined in claim 1, wherein said holding and locking means are unitary.

3. A connector as defined in claim 1, wherein said holding and locking means comprise:

at least one flexible strip of insulating material having one end integral with said contact holder casing and another end being free and ending in a bevelled edge preceded by a notch and a shoulder set back in relation to the free end; and at least one guide housing integral with said base plate in which said flexible strip is slidably received, said guide housing provided with stop means in the form of an interior projection; and said corresponding printed circuit having a hole adapted to receive said free end of the flexible strip such that when said casing is in said first storage and transport position, said projection of said guide housing is engaged within said notch of said strip to hold said casing in said first position, and when said casing is in said second operating position, said shoulder on said strip engages said printed circuit to lock said connector to said printed circuit.

4. Connector, as defined in claim 3 wherein said at least one flexible strip includes at least two strips and wherein said at least one guide housing includes at least two guide housings integral with said base plate and positioned at the periphery of said connector.

* * * * *

UNITED STATES PATENT AND TRADEMARK OFFICE

CERTIFICATE OF CORRECTION

PATENT NO. : 4,992,054

DATED : February 12, 1991

INVENTOR(S) : Daniel Cassan

It is certified that error appears in the above—identified patent and that said Letters Patent is hereby corrected as shown below:

On the title page, item [73] should be

Assignee: SOCIETE FRANCAISE METALLO, FRANCE

Signed and Sealed this

Nineteenth Day of January, 1993

*Attest:*

DOUGLAS B. COMER

*Attesting Officer*

*Acting Commissioner of Patents and Trademarks*